United States Patent [19]

DeLano

[11] 4,037,815

[45] July 26, 1977

[54] MUSICAL INSTRUMENT SUPPORT

[75] Inventor: Arthur D. DeLano, Battle Creek, Mich.

[73] Assignee: D & J Products, Battle Creek, Mich.

[21] Appl. No.: 706,699

[22] Filed: July 19, 1976

[51] Int. Cl.[2] ..... A47F 5/00

[52] U.S. Cl. ..... 248/285; 84/327; 248/316 A

[58] Field of Search ..... 248/274, 285, 286, 287, 248/443, 172, 173, 316 R, 316 C, 316 A, 309, 310; 297/186; 206/314, 14; 84/327, 329

[56] References Cited

U.S. PATENT DOCUMENTS

| | | | |
|---|---|---|---|
| 2,510,799 | 6/1950 | Carley | 84/327 |
| 2,547,924 | 4/1951 | Citro | 84/327 |
| 2,737,361 | 3/1956 | Petzke | 248/316 A |
| 3,958,786 | 5/1976 | Mann | 84/327 |

*Primary Examiner*—Robert A. Hafer

*Attorney, Agent, or Firm*—Fisher, Gerhardt & Groh

[57] ABSTRACT

A musical instrument support for holding an instrument on a wall mounted bracket in elevated position above the floor. The instrument support is detachable from the bracket and is collapsible from a position in which it holds the instrument to a transport or storage position and is provided with scales to facilitate unfolding the instrument support to a desired size to accommodate a given instrument.

11 Claims, 5 Drawing Figures

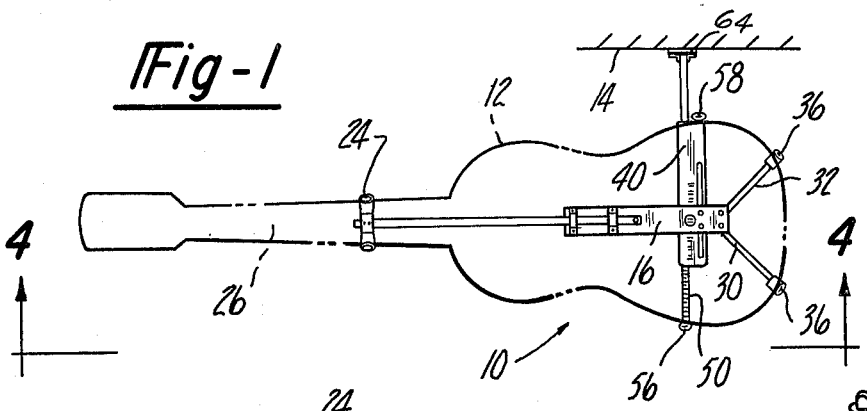
Fig-1
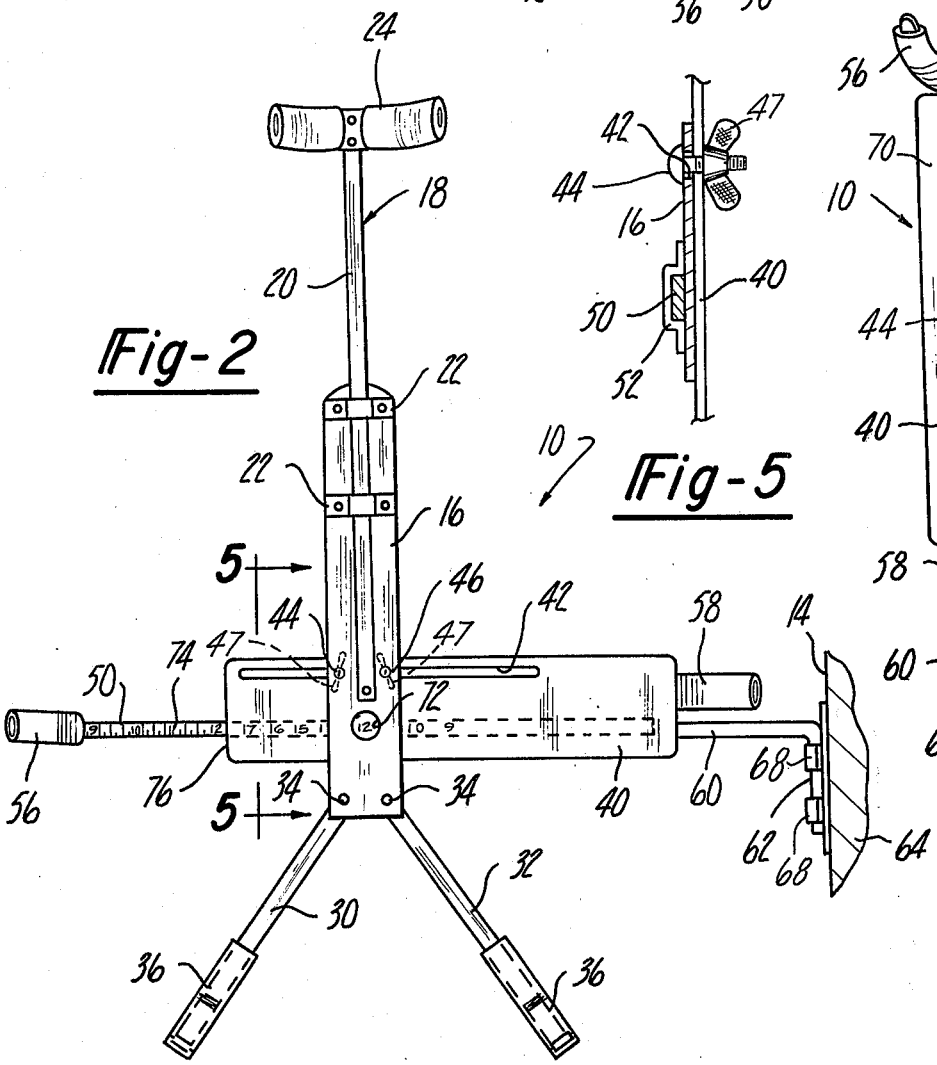
Fig-2
Fig-5
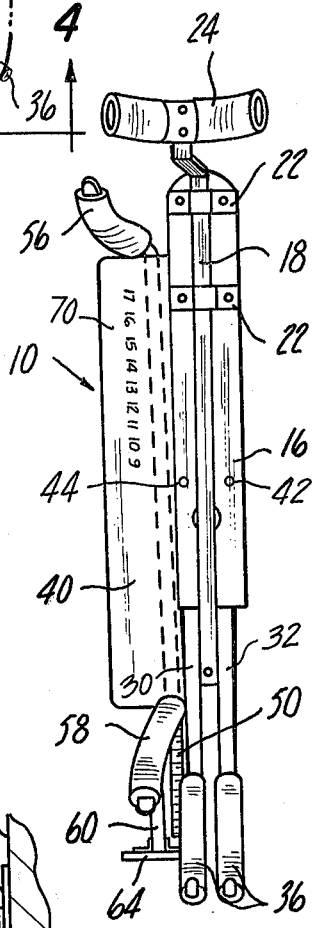
Fig-3
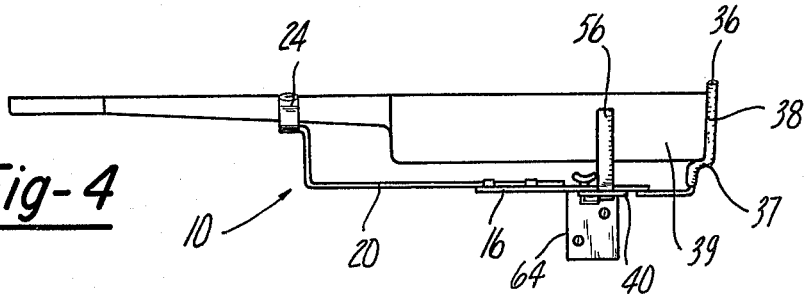
Fig-4

MUSICAL INSTRUMENT SUPPORT

This invention relates to support devices for musical instruments and particularly to a support for stringed musical instruments.

The instrument support device is provided with a bracket by which it may be detachably supported relative to a wall in elevated position to the floor so that the instrument is positioned for ready use or for display purposes.

It often is desirable to leave stringed instruments out of their protective carrying cases but in a safely supported position. For example, musicians who play more than one instrument desire ready access to the next instrument to be played and a safe place to rest the prior played instrument. Also, stringed instruments often are decorative and musicians prefer to display the instrument when it is not being used rather than placing it in its protective carrying case. In addition, the display of numerous stringed instruments in a store preferably is made with the instrument out of its carrying case.

It is an object of the invention to provide a stringed instrument support device by which the instrument may be supported relative to a wall.

Another object of the invention is to provide a stringed instrument supporting device which may be adjusted to accommodate different sizes of stringed instruments.

Still another object of the invention is to provide a stringed instrument support device which may be readily collapsed for storage or transport.

A further object of the invention is to provide an instrument holding device which may be easily and rapidly adjusted to accept an instrument of a predetermined size without the necessity of fitting the device to the instrument.

The stringed instrument supporting device has a base member with extending supports for engaging one end of the body member of the instrument and a member slidably movable relative to the base member to engage the neck of the stringed instrument. Oppositely extending arms may be moved to selected positions relative to the base member to engage the sides of the instrument and scales are provided on the arms to facilitate moving the arms equal distances from the base member and to some predetermined position to accommodate a given instrument.

FIG. 1 is a plan view of the musical instrument support device embodying the invention showing its relative position to a musical instrument;

FIG. 2 is a view at an enlarged scale of the instrument support device in its extended position ready to receive an instrument;

FIG. 3 is a plan view of the instrument support device in its collapsed, storage position;

FIG. 4 is an elevation taken in the direction of line 4—4 in FIG. 1 showing the instrument in its supported position in the device; and FIG. 5 is a cross-sectional view at an enlarged scale taken on line 5—5 in FIG. 2.

Referring to the drawings, the musical instrument support embodying the invention is designated at 10 and is shown in position supporting a musical instrument 12 in the form of a guitar. The support may be attached to a wall 14 for supporting an instrument horizontally on its back as seen in FIG. 10 although the support 10 may be positioned vertically as seen in FIG. 2 or in other selected positions.

The musical instrument support 10 includes a base member 16 which is intended to extend generally longitudinally of the instrument 12 and at its back side. The base member 16 supports a neck bracket 18 which has an elongated bar 20 held for sliding movement by spaced apart guides 22 to the top surface of the base member 16. The free end of the bar member 20 is provided with a yoke 24 which is covered with a resilient padding material and is adapted to cradle the elongated neck 26 of the instrument 12.

The end of the base member 16 opposite to the neck bracket 18 is provided with a pair of legs 30 and 32 which are pivoted at 34 by rivets or the like. The free ends of the leg members 30 and 32 are provided with supports 36 which may be covered with resilient material such as foam rubber tubing. The brackets 36 are offset at 37 as seen in FIG. 4 and are adapted to engage the end wall 38 and back 39 of the musical instrument 12 when the legs 30 and 32 are positioned as seen in FIG. 3 in their diverging, instrument supporting position. In the storage position, the legs 30 and 32 are parallel to each other and in longitudinal alignment with the base member 16 as shown in FIG. 3.

The base member 16 supports a transversely extending main arm 40. The main arm 40 has an elongated slot 42 adjacent one marginal edge. The slot 42 receives a pair of bolts 44 and 46 which receive wing nuts 47 (FIG. 2). Upon loosening of the wing nuts 47, the bolts 44 and 46 slide in a groove 42 during transverse movement of the main arm member 40 relative to the base member 16 and serve to maintain the arm member transverse to the base member. Tightening of the wing nuts 47 on the bolts 44 and 46 serves to maintain the arm member 40 in its selected position of adjustment.

An auxiliary arm member 50 is supported from the main arm member 40 for adjustment longitudinally of the latter and transversely to the base member 16. The auxiliary arm member is mounted at the underside of the main arm member for sliding movement in a socket bracket 52 at the underside of the auxiliary arm 40. The socket bracket 52 permits sliding movement relative to the base member 16 and frictionally engages the auxiliary arm 50 so that the latter remains in its selected positions of adjustment. The free end of the auxiliary arm 50 is provided with a support portion 56 which is similar to the support portions 36 on the leg members 30 and 32 and is covered with a resilient tubular member to cushion engagement with the instrument 12. The end of the main arm opposite to the auxiliary arm 50 is provided with a support bracket 58 which is generally similar to the support bracket 56 and is disposed parallel thereto for engaging the opposite side of the instrument 12.

A mounting bracket 60 is rigidly connected to the auxiliary arm 40 adjacent to the support 58. The mounting bracket 60 is provided with a pin 62 which may be received in a socket member 64. The socket member 64 includes a plate 66 which is adapted to be connected to the wall and its exposed face is provided with a pair of bracket elements 68 which slidably receive the pin portion 62. When the pin 62 is inserted in the socket 64 the instrument support is held on the wall in an elevated position relative to the floor. As seen in FIG. 1 the instrument support 10 is positioned in the bracket 64 so that the instrument may be placed on the support 10 and be supported generally horizontally on its back. If desired, however, the pin 62 may be bent relative to the arm as seeb in FIG. 2 so that when the pin 62 is disposed in the socket member 64, the instrument will be disposed in an upright position. The arm between the pin 62 and the main arm 40 may be bent in various configurations and angles to support the instrument in various positions relative to the wall for easy access or display.

To adjust the support device in readiness to accept and support the instrument 12, the legs 30 and 32 are disposed in diverging relationship to each other as seen in FIG. 3 and with the instrument placed against the supports 36 the neck member 18 may be extended longitudinally of the base member 16 so that the yoke 24 engages the instrument 12 at a desired location longitudinally of the neck 26. Thereafter, the main arm 40 and the auxiliary arm 50 are adjusted so that the support portions 56 and 58 engage the sides of the instrument.

Referring to FIG. 3 the main arm 40 is provided with a scale 70 with graduations indicating units of measurement. The numerals identifying the position on the scale are visible through an opening 72 along the central longitudinal axis of the base member 16 and as seen in FIG. 2 the numeral 12 appears in the opening indicating that the support 58 is 12 units from the center line of the base member 16. The auxiliary arm 50 also is provided with a linear scale 74 of the same calibration as the scale on the main arm 40. As seen in FIG. 3 when the index reading adjacent the left end 76 of the base member 40 is the same as the reading in the opening, the support portions 56 and 58 are spaced equal distances from the longitudinal center line of the base member 16. Once the adjustment is made for a particular instrument it simply is necessary to move the main arm member 40 and auxiliary arm member 50 to the reading relating to that instrument to insure that the latter will fit within the supports 56 and 58.

When it is desired to 'store the instrument support device the entire unit may be folded or collapsed into a compact storage condition as seen in FIG. 3. This is accomplished by folding the legs 30 and 32 towards each other so that they are generally parallel as seen in FIG. 3 and by moving the neck support bracket 18 longitudinally of the base member 16 until the yoke 24 is adjacent to one end of the base member 16. Thereafter, one or the other of the bolts 44 or 46 is removed and the main arm member 40 may be pivoted around the remaining bolts 44 or 46 so that the main arm member 40 assumes the position relative to the base member 16 seen in FIG. 3. The remaining bolt 44 or 46 also permits the main arm member 40 to slide in the slot 42 relative to the base member. The auxiliary arm 50 may be moved longitudinally of the main arm 40 to position the auxiliary arm with the support 56 adjacent to the end of the main arm 40. With the various parts in the position shown in FIG. 4 the support device is compact and ready for storage or transport.

A musical instrument support has been provided in which an instrument may be supported from a wall in an elevated position relative to the floor by means of a collapsible device which folds to a compact storage position and which may be unfolded to support an instrument at several different points. The musical instrument support is unfolded by pivoting legs for engaging the body member of the musical instrument by sliding a yoke to a selected position relative to the neck of the instrument and the sides of the instrument are engaged by supports which are moved to their proper position with the aid of indicia which indicate when oppositely extending arms have been moved equal distances from the center line of the instrument support device.

The embodiments of the invention in which an exclusive property or privilege is claimed are defined as follows:

1. An adjustable support device for holding stringed instruments comprising; a base member, a neck bracket supported on said base member for movement to selected positions longitudinally thereof and from one end of said base member to support the finger board of an instrument, support means connected to the other end of said base member for engagement with the body member of the stringed instrument, a pair of arms extending transversely to opposite sides of said base member for adjustment to selected positions, said free ends of said arms being provided with instrument engaging portions, and bracket means connected to one of said arms and being adapted for detachable connection to a wall or the like to maintain said device in elevated position.

2. The combination of claim 1 in which each of said arms is provided with indicia to indicate the extent of adjustment of the arms relative to said base structure.

3. The combination of claim 1 in which said support means includes a pair of leg brackets extending from said base member in diverging relationship for engagement with the body portion of said stringed instrument.

4. The combination of claim 3 in which said leg brackets are pivoted relative to said base member for movement from said diverging position to a parallel storage position extending generally longitudinally of said base member.

5. The combination of claim 1 in which one arm of said pair of arms is supported from said base and in which the other arm of said pair of arms is supported relative to said one arm.

6. The combination of claim 2 in which said indicia includes a first scale on one arm and a first reference point on said base and a second scale on the other of said arms and a second reference point on said one arm.

7. The combination of claim 6 in which one of said reference points is an opening in said base for making selected portions of the associated scale visible.

8. The combination of claim 1 and further comprising mounting means connecting said arms to said base member for sliding movement transversely thereof and pivotal movement from an instrument support position to a storage position.

9. The combination of claim 8 in which said neck bracket, base member and arms are disposed generally parallel to each other in said storage position.

10. An adjustable support device for holding a stringed instrument comprising; a base member, a neck bracket supported on said base member for movement to selected positions longitudinally thereof from one end of said base member to support the finger board of an instrument, a pair of legs pivotally connected to the other end of said base member for movement from a parallel storage position to a diverging support position for engagement with the body member of the stringed instrument, a main arm extending transversely of said base member into one side thereof for movement to selected positions transversely of said base member, an auxiliary arm supported on said main arm for movement longitudinally thereof and transversely to said base member to the other side thereof, a pair of support elements supported on said main arm member and said auxiliary arm member respectively at opposite sides of said base member for engagement with opposite sides of the body member of said instrument and a graduated scale on said main arm for indicating positions of adjustment relative to said base member and a graduated scale on said auxiliary arm for indicating positions of adjustment relative to said main arm.

11. The combination of claim 10 in which said main arm is mounted on said base member for pivotal movement between an instrument support position and a storage position.

* * * * *